US006113100A

United States Patent [19]

Mu

[11] Patent Number: 6,113,100

[45] Date of Patent: Sep. 5, 2000

[54] DEVICE FOR ARRANGING RECTANGULAR PARALLELEPIPED FLAT TILES USED FOR TILE GAMES

[76] Inventor: Bing Mu, 1-2-15-306 Takeshirodai, Sakai-shi Osaka, Japan

[21] Appl. No.: 09/198,834

[22] Filed: Nov. 24, 1998

[30] Foreign Application Priority Data

Dec. 1, 1997 [JP] Japan ..... 9-329928

[51] Int. Cl.[7] ..... A63F 9/20

[52] U.S. Cl. ..... 273/149 R; 273/309

[58] Field of Search ..... 273/149 R, 309

[56] References Cited

U.S. PATENT DOCUMENTS

| | | | |
|---|---|---|---|
| 3,899,178 | 8/1975 | Watanabe | 273/309 |
| 4,219,200 | 8/1980 | Takahashi | 273/309 |
| 4,264,074 | 4/1981 | Sobajima | 273/149 R |
| 4,534,561 | 8/1985 | Okuno et al. | 273/149 R |

FOREIGN PATENT DOCUMENTS

| | | | |
|---|---|---|---|
| 52-46952 | 4/1977 | Japan | 273/149 |

*Primary Examiner*—Raleigh W. Chiu
*Attorney, Agent, or Firm*—Thomas Schneck

[57] ABSTRACT

In order to automatically arrange tiles of rectangular flat parallelepipeds having the front and the back which are put in disorder, these tiles are discharged one by one with their flat side down in a manner that the longitudinal direction of the tiles matches the predetermined direction. Then, it is judged whether the discharged tiles are turned with the front down or the back down. When the tiles have been judged not to be turned as desired, they are turned over while being carried; otherwise they are carried without being turned over. Finally the tiles are arranged in the predetermined conditions.

15 Claims, 10 Drawing Sheets

DEVICE FOR ARRANGING RECTANGULAR PARALLELEPIPED FLAT TILES USED FOR TILE GAMES

BACKGROUND OF THE INVENTION (1) Field of the Invention

The present invention relates to a device for automatically arranging flat tiles used for paigow or other similar tile games.

(2) Description of the Prior Art

To play mah-jongg, it is necessary to shuffle mah-jongg tiles and to pile them up into the fixed arrangement. In recent years, automatic mah-jongg tables have been widely used to save players such labor.

In the automatic mah-jongg tables, each tile contains a magnet sealed therein in such a manner that the South pole faces the front of the tiles and that a strong North pole magnetic force is applied from under the shuffled tiles so as to turn all the tiles face down. The tiles thus turned face down are conveyed along a passage to be piled up into the fixed arrangement and lifted onto the table.

A game called paigow also requires that shuffled tiles are piled up in the fixed arrangement like mah-jongg. Paigow is played with 32 tiles and the dealer distributes four tiles to each player who tries to get a winning combination with four tiles. Before starting the game, the dealer is supposed to place tiles each having the shape shown in FIG. 1 arranged in eight rows of four levels each as shown in FIG. 2.

The players of this game also have desired a device for automatically arranging tiles. However, as shown in FIG. 1 the tiles used for paigow are thinner than normal mah-jongg tiles, requiring an extremely high moment to be turned over. For this reason, it is impossible to turn all the tiles face down by sealing a magnet into each tile and applying a strong magnetic force from below or above the tiles as in the automatic mah-jongg tables.

SUMMARY OF THE INVENTION

The object of the present invention is to overcome the above-mentioned problems and to provide a device for automatically arranging flat tiles in such a game as paigow requiring the tiles to be arranged after being shuffled.

The above object is achieved as follows. In the device according to the present invention, flat tiles of rectangular parallelepipeds, which have the front and the back and are put in disorder, are discharged one by one with their flat side down in a manner that the longitudinal direction of the tiles matches the predetermined direction. A front/back judgment unit judges whether the discharged tiles are turned with the front down or the back down. When the tiles have been judged not to be turned as desired, they are turned over while being carried; otherwise they are carried without being turned over. Finally an arrangement unit arranges the tiles in predetermined conditions.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Embodiment 1

Figure 2:
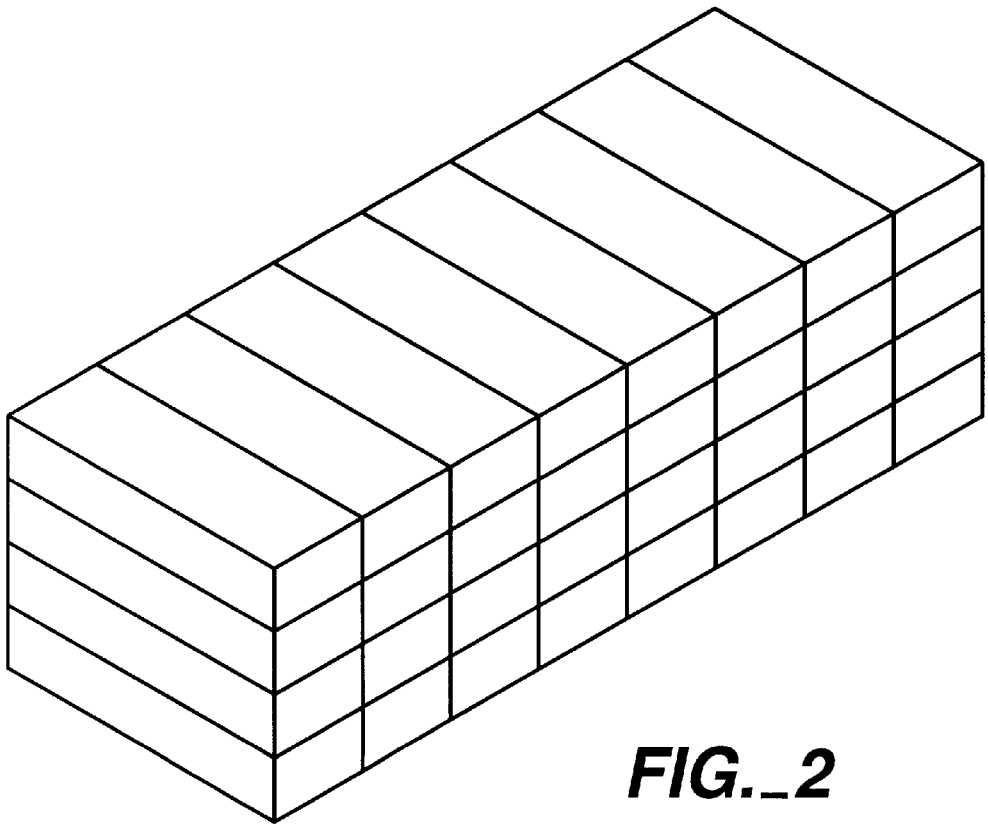
FIG. 2 is a perspective view of arranged tiles.
Figure 3:
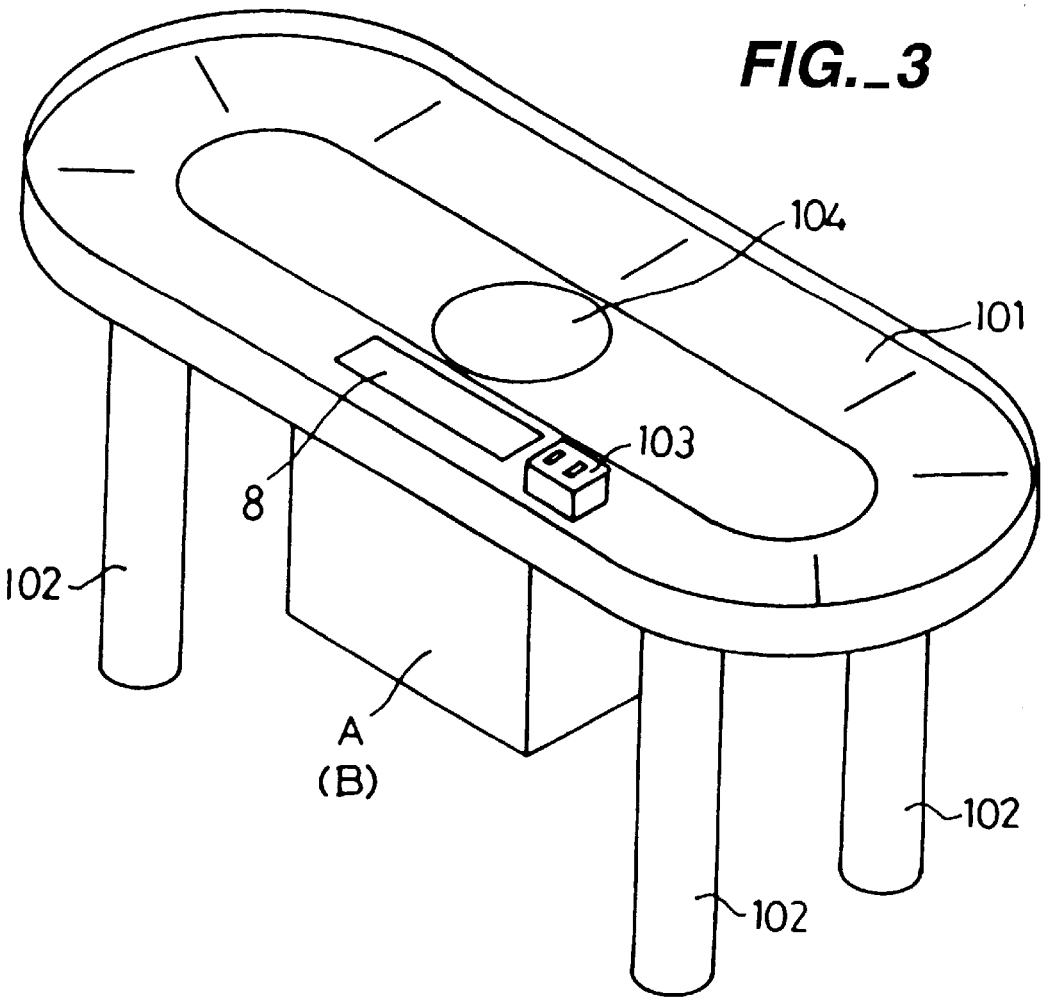
FIG. 3 is a perspective view of the appearance of the game table in the embodiments.

The first embodiment of the present invention will be described as follows with reference to the drawings. FIG. 3 is a perspective view showing the appearance of the game table for paigow in accordance with the present embodiment. As shown in this drawing, the game table is composed of an oval-shaped top 101 and four legs 102 supporting the top 101 which has lines and other drawings on it to indicate the area assigned to each player. A tile arrangement device A of the present invention is provided under the top 101. The tile arrangement device A is operated with a switch box 103 provided on the top 101; when tiles are put into the tile arrangement device A by opening an opening 104 provided in the center of the top 101, a lift 8 rises with the tiles thereon which are arranged in eight rows of four levels each as shown in FIG. 2.

Figure 4:
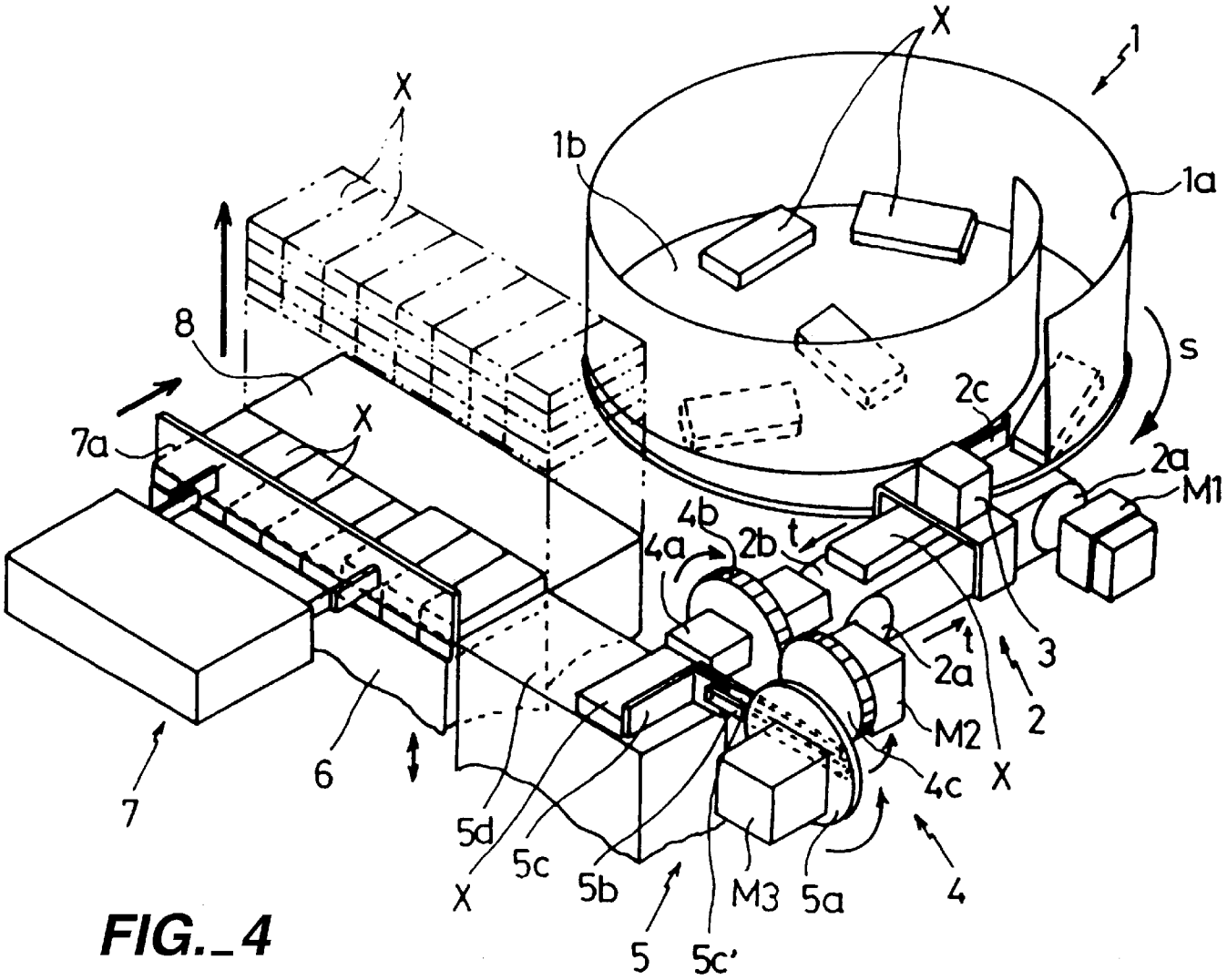
FIG. 4 is a perspective view of the structure of the tile arrangement device of the first embodiment.
Figure 5:
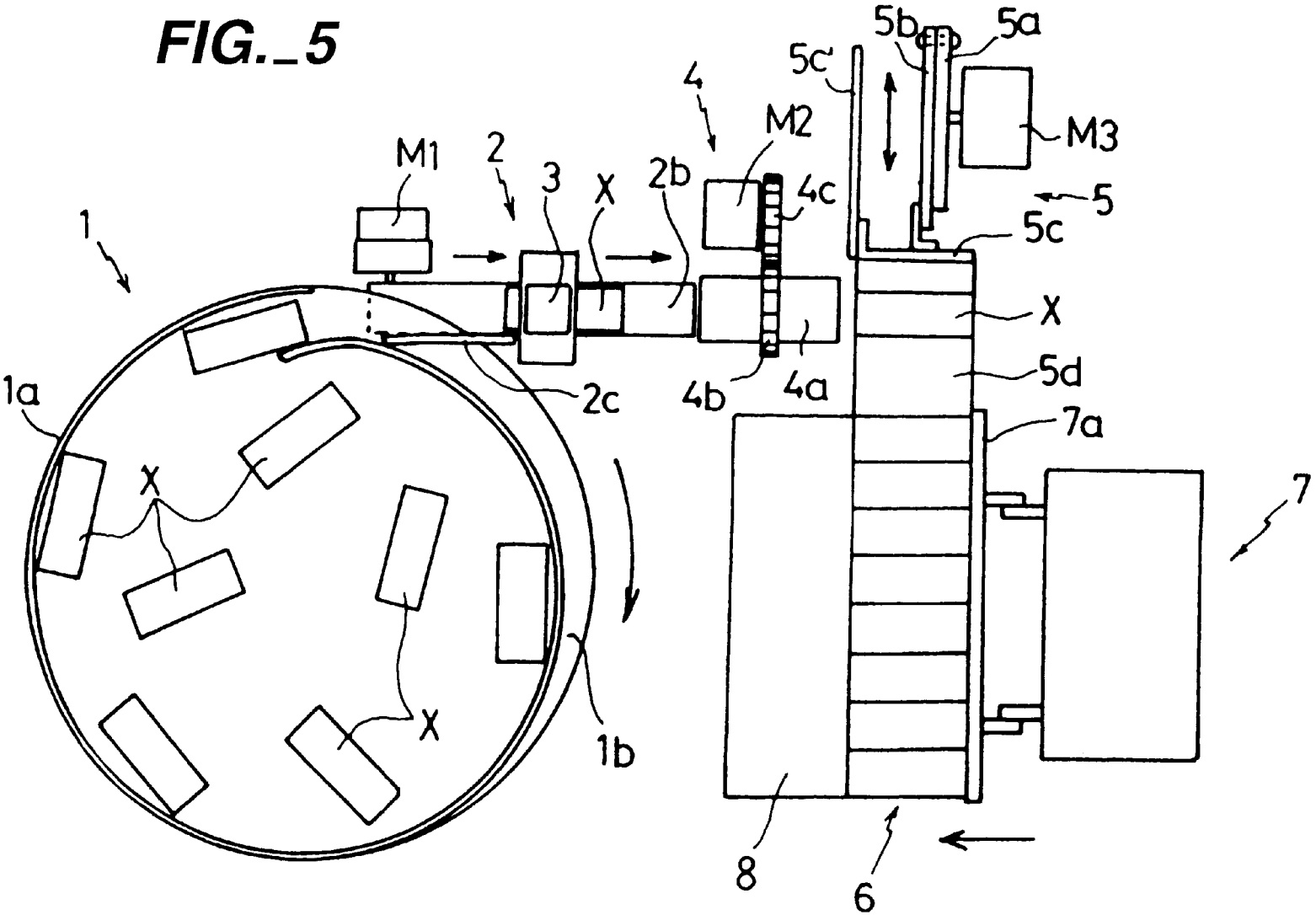
FIG. 5 is a plane view of the structure of the tile arrangement device of the first embodiment.

FIGS. 4 and 5 are respectively a perspective view and a plane view showing the structure of the tile arrangement device A. The tile arrangement device A is composed of a direction match unit 1 disposed beneath the opening 104, a conveyer unit 2 for conveying tile discharged from the direction match unit 1, a front/back judgment unit 3 for judging the front and the back of each tile passing through the conveyer unit 2, a reversal unit 4 for turning over the tiles conveyed by the conveyer unit 2 in case of necessity, an arrangement stand 6 for arranging the tiles as shown in FIG. 2, a slide unit 5 for sliding the tiles passed through the reversal unit 4 one by one towards the arrangement stand 6, a lift 8 for lifting the arranged tiles onto the top 101, and a pushing unit 7 for pushing the arranged tiles as they are onto the lift 8. These units are controlled by a control device composed of CPU, RAM, ROM, and a driver to control driving sources such as motors all of which are unillustrated. The control is performed by a program to achieve the following operations which is stored in the ROM.

The direction match unit 1 is composed of a coiled side wall 1*a* and a disk 1*b* which rotates in the direction indicated by an arrow s. The disk 1*b* is rotated continuously or intermittently by an unillustrated driving source, so that rectangular parallelepiped flat tiles X, which have been dropped through the opening 104 into the direction match unit 1 and placed on the disk 1*b* in disorder, are moved towards the inner side of the side wall 1*a* by a centrifugal force. During the travel process, all the tiles X have come to be laid in a stable state with their flat side down although some tiles are laid face down and the others face up. The tiles X reached the inner wall move in the direction of the rotation of the disk 1*b* along the wall surface. At this stage, the tiles X, which are still affected by the centrifugal force, try to be in most stable state with two corners of their flat side in contact with the wall surface. The tiles X in this state continue to move along the wall surface and are finally discharged from the outlet of the coiled wall surface. Even when a tile X cannot be in the state with the two corners in contact with the wall surface before it reaches the outlet, if only the smallest side of the tile X touches the outlet, the tile X is turned around so as to fit the outlet. When a tile X has failed to reach the outlet, it travels again in the direction of the rotation of the disk 1*b* along the wall surface so as to make the two corners be in contact with the wall surface, and is discharged through the outlet.

The conveyer unit 2 is composed of a pair of rollers 2*a*, 2*a*, a conveyer belt 2*b* stretching between the rollers 2*a*, 2*a*, and a guide plate 2*c* for guiding the tiles X discharged from the direction match unit 1 to the conveyer belt 2*b*. One of the rollers 2*a*, 2*a* is driven by a motor M1 so as to rotate the conveyer belt 2*b* in the direction indicated by an arrow t. The direction of the stretch of the conveyer belt 2*b* nearly matches the direction of the discharge of the tiles X from the direction match unit 1, that is, the direction tangent to the rotation of the tiles X by the disk 1*b*. The guide plate 2*c* is provided on the side of the direction match unit 1 in the direction of the stretch of the conveyer belt 2*b* in order to prevent the rotation of the tiles X, thereby to guide them onto the conveyer belt 2*b*. In this structure, the tiles X discharged from the direction match unit 1 are carried onto the conveyer belt 2*b* while being hindered from rotating by the guide plate 2*c*, and conveyed on the conveyer belt 2*b*.

Figure 1:
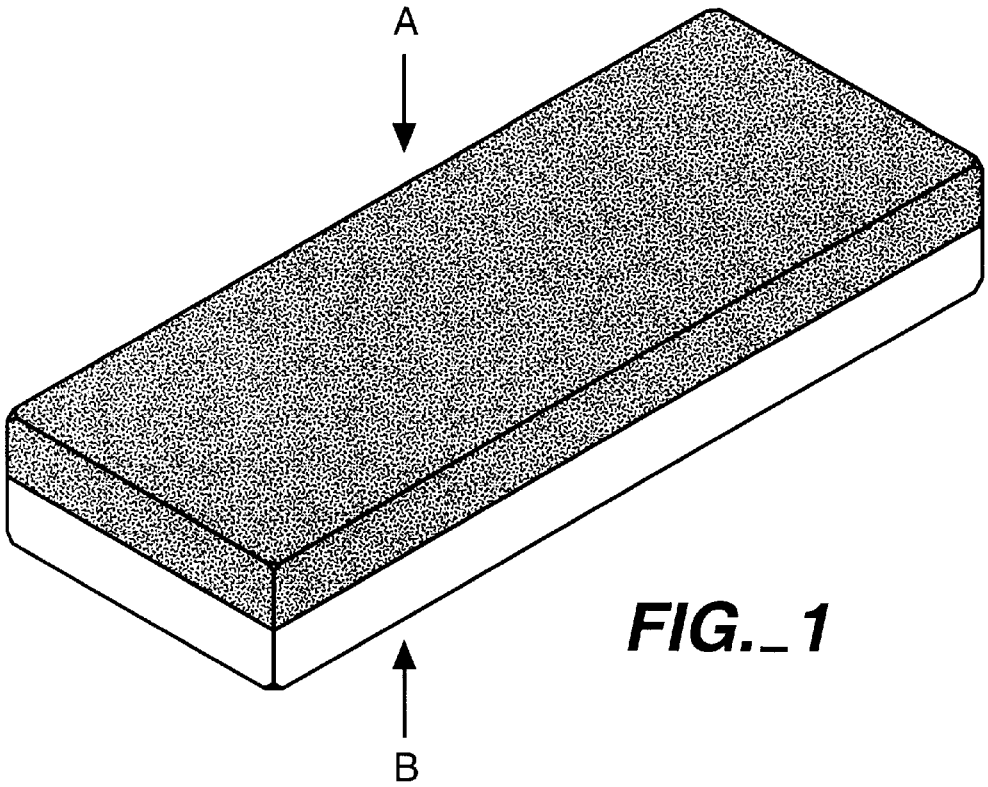
FIG. 1 is a perspective view of the appearance of a tile.

The front/back judgment unit 3, which is composed of an optical sensor, judges the front and the back of each tile X conveyed on the conveyer belt 2*b* above the conveyer belt 2*b*. To be more specific, as shown in FIG. 1 each tile X consists of a back A made of a colored material so that its color density is high and a front B made of a white material having carved symbols thereon which are exclusively colored so that its color density is low as a whole. The optical sensor applies light to a tile X to detect the density of the reflected light, and judges the front and the back of the tile X from whether the density exceeds the predetermined value or not. Besides this method, various other measures can be adopted to judge the front and the back of the tiles X. For example, pictorial features such as bar codes or specific symbols, or a reflection board can be provided at a fixed portion of each tile X and optically detected. As another method, a magnetic material can be applied on one of the front and the back of each tile X and detected by a magnetic sensor. As further another method, a concavity or a convexity can be provided at a fixed portion on one of the front and the back of each tile X and its presence or absence can be detected by physically contacting the surfaces of the tiles X.

Figure 6:
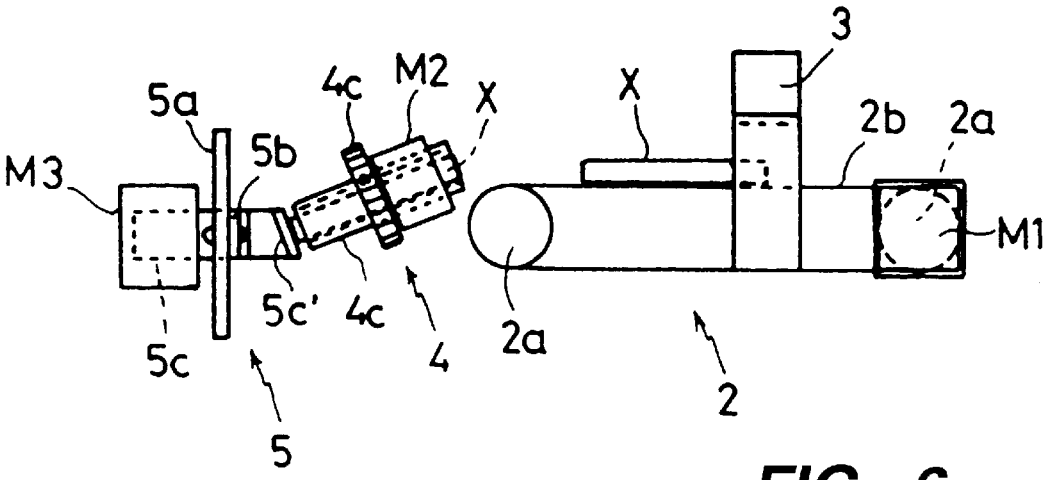
FIG. 6 is a side view of the reversal unit.

The reversal unit 4 is composed of a rectangular parallelepiped member 4*a* having a rectangular parallelepiped through-hole slightly larger than the size of a tile X so as to allow each of them to pass it through smoothly, a first gear 4*b* put into the rectangular parallelepiped member 4*a* in such a manner as to match its rotation axis with the long axis of the member 4*a*, and a second gear 4*c* engaged with the first gear 4*b*. FIG. 6 is a side view of the reversal unit 4 and its vicinity. As shown in the drawing, the rectangular parallelepiped member 4*a* slopes in the direction of the travel of the tiles X and is positioned to allow the tiles X moving on the conveyer belt 2*b* to pass through. The rectangular parallelepiped member 4*a* makes a 180° turn when the second gear 4*c* is rotated by a stepping motor M2. Thus, a tile X in the rectangular parallelepiped member 4*a* can be turned over in case of necessity. In the present embodiment, the tiles X are turned over when the front/back judgment unit 3 judges the side to be the front.

The slide unit 5 is composed of a link mechanism consisting of a link plate 5*a* and a link arm 5*b*, a slide plate 5*c* sliding with the link arm 5*b*, and a slide stand 5*d* on which the slide plate 5*c* slides to push a tile X forward. The rotation of the link plate 5*a* is driven by a stepping motor M3. The link mechanism consisting of the link plate 5*a* and the link arm 5*b* makes the slide plate 5*c* reciprocate on the slide stand 5*d* towards the arrangement stand 6. In the reciprocation, when the link mechanism is entirely withdrawn and the slide plate 5*c* is in the farthest position from the arrangement stand 6, a tile X is discharged onto the slide stand 5*d* passing through the reversal unit 4. When the slide plate 5*c* is in another position, the block plate 5*c*' provided at the slide plate 5*c* blocks the discharge of a tile X from the reversal unit 4. On the other hand, when the link arm 5*b* is fully stretched and the slide plate 5*c* is in the closest position to the arrangement stand 6, the slide plate 5*c* touches the edge of the arrangement stand 6 on the side of the slide unit 5. Furthermore, an unillustrated micro switch is provided on the top surface of the slide stand 5*d* in order to detect the discharge of a tile X onto the slide stand 5*d*. According to this structure, when a tile X is discharged onto the slide stand 5*d*, the link mechanism makes the slide plate 5*c* slide on the slide stand 5*d* towards the arrangement stand 6 so as to push the tile X towards the arrangement stand 6. Then, when the link arm 5*b* is fully stretched, the slide plate 5*c* touches the edge of the arrangement stand 6 so that the tile X is properly placed on the edge of the arrangement unit 6 on the side of the slide unit 5.

The arrangement stand 6 has a top surface of such a size and shape as fits eight tiles X arranged lengthwise side by side, and is moved vertically by an unillustrated elevation mechanism. As the elevation mechanism, well-known mechanisms such as a crank mechanism and a ball thread are available. The vertical movement is conducted in three levels each corresponding to the thickness of a tile X. In FIG. 4, the arrangement stand 6 is lowered one level from the highest level. When the arrangement stand 6 is in the highest level, its top surface forms a single plane with the top surface of the slide stand 5*d*, and every time eight tiles have been arranged on its top surface, the arrangement stand 6 is lowered one level. The presence of eight tiles is recognized by counting the detection output from the unillustrated micro switch provided on the top surface of the slide stand 5*d*. When the total of 32 tiles have been arranged, the arrangement stand 6 rises to return to the highest level.

The pushing unit 7 is composed of a pushing board 7*a* which pushes the tiles X arranged on the arrangement stand 6 onto the lift 8 by an unillustrated pushing mechanism. When it is in its most advanced position, the pushing board 7*a* is supposed to come in contact with the edge of the lift 8 which is in contact with the arrangement stand 6. The pushing board 7*a* pushes the tiles X arranged as shown in FIG. 2 on the arrangement stand 6 just as they are onto the lift 8. As the pushing mechanism, other mechanisms including a crank mechanism can be adopted.

The lift 8, which is moved vertically by an elevation mechanism such as a ball thread, lifts the arranged tiles X onto the top of the game table shown in FIG. 3. The lift 8 is in the raised state while the game is being played, and lowered only to lift arranged tiles.

The operations of the tile arrangement device A having the above-mentioned structure will be described as follows. When one game is over, the dealer operates the switch box 103 on the top 101 so as to make an unillustrated opening mechanism open the opening 104, and puts all the tiles X thereinto. When the opening 104 is opened, the tile arrangement device A starts to operate, and the disk 1*b* of the direction match unit 1 and the motor M1 of the conveyer unit 2 start to rotate. While one set of tiles are being used for a game, the other set of tiles are already arranged on the lift 8, ready to be lifted for the next game.

All the tiles X put into the opening 104 drop on the disk 1*b* enclosed by the side wall 1*a* of the direction match unit 1, and are discharged through the outlet one by one with their flat side down and their smallest side ahead, as the result of the above-described operation.

The tiles X discharged from the direction match unit 1 are conveyed by the conveyer unit 2 and the front and the back of the tiles X are judged by the front/back judgment unit 3 one by one. The tiles X whose front and back have been judged by the front/back judgment unit 3 are carried to pass through the rectangular parallelepiped member 4*a* of the reversal unit 4. When the front/back judgment unit 3 has judged that a tile X is laid face up, the stepping motor M2 drives the second gear 4*c* and the first gear 4*b* to turn over the rectangular parallelepiped member 4*a*, thereby to turn over the tile X in the member 4*a*. In contrast, when the front/back judgment unit 3 has judged that a tile X is laid face down, the reversal unit 4 performs no operation.

A tile X which has passed through the reversal unit 4 is discharged on the slide stand 5*d* of the slide unit 5 and detected by the unillustrated micro switch on the slide stand 5*d*. The detection signal makes a motor M3 drive and the link plate 5*a* rotate, making the link arm 5*b* stretch and the slide plate 5*c* provided at the tip of the link arm 5*b* slide the tile X towards the arrangement stand 6. When the tile X is laid on the edge of the arrangement stand 6, the link arm 5*b* starts the reverse movement to return to the entirely withdrawn condition. Unless the link arm 5*b* is in this condition, a tile X in the reversal unit 4 cannot be discharged as mentioned above, so that every time the link plate 5*a* has made one rotation, only one tile X is discharged onto the slide stand 5*d* and laid onto the arrangement stand 6, pushing the tiles X laid earlier ahead.

Every time the link plate 5*a* has rotated eight times and eight tiles X are arranged in the arrangement stand 6, the arrangement stand 6 is lowered one level, and when the total of 32 tiles X are arranged on it, the arrangement stand 6 rises again to return to the original condition.

The 32 tiles X arranged on the arrangement stand 6 wait to be lifted. The operation so far is completed without fail before the next game starts because it takes far less time than one game. When the dealer operates the switch box 103 to start the next game, the lift 8 is lowered. At this moment, as described above, one set of tiles used for the game are put into the direction match unit 1 through the opening 104. When the lift 8 has reached the lowest level, the pushing unit 7 pushes the arranged tiles X as they are towards the lift 8. When the tiles X are laid on the lift 8, it starts to rise and places the arranged 32 tiles X onto the top 101. Through these operations, tiles X are automatically arranged.

Figure 7:
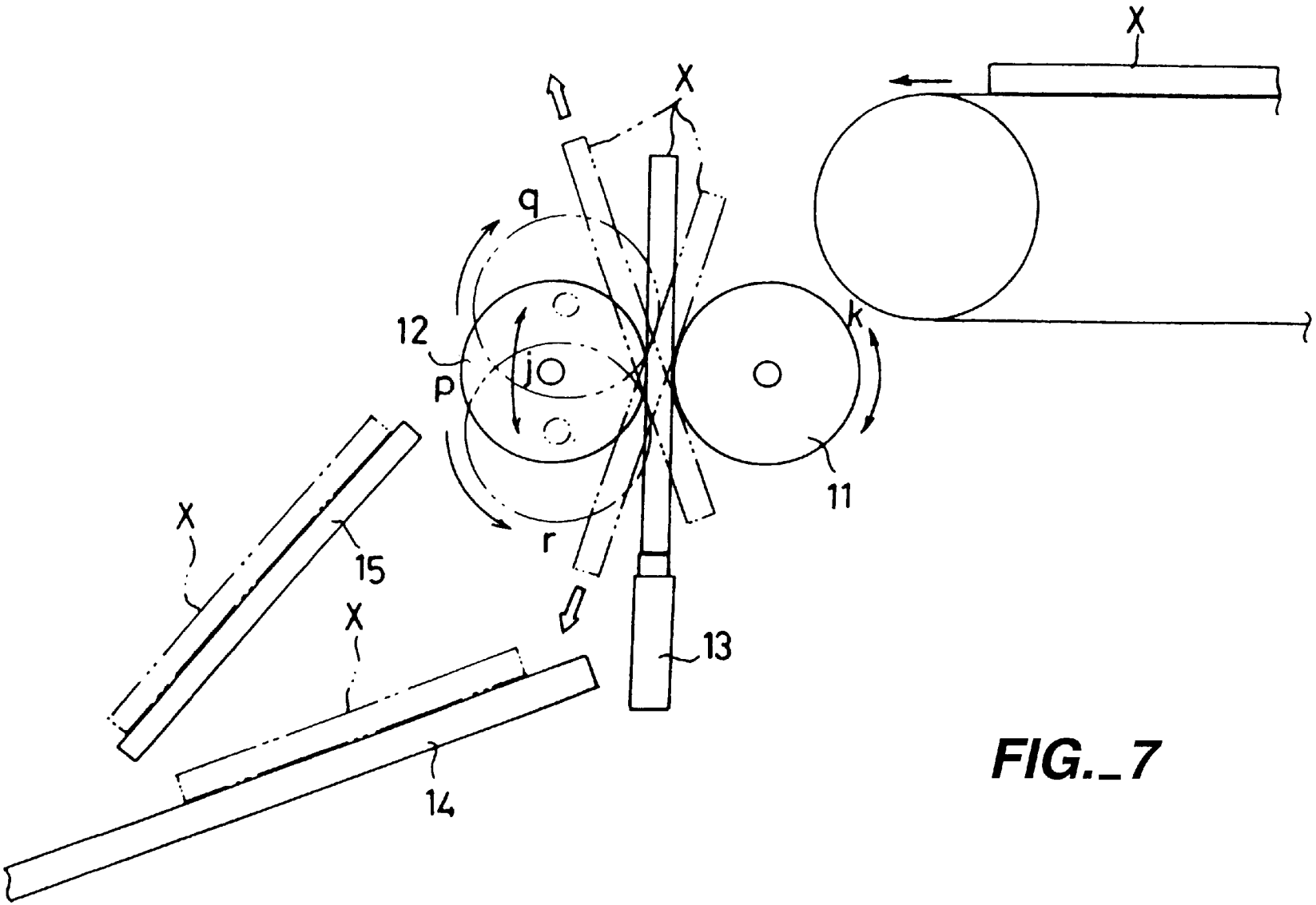
FIG. 7 is a side view of a modified example of the reversal unit.

In the present embodiment, the tiles X are reversed by putting them in a rectangular parallelepiped member; however, other reverse mechanisms such as the one shown in FIG. 7 can be adopted. This reverse mechanism is composed of a pair of rollers 11, 12. The rotation of the roller 11 is driven by an unillustrated motor, whose rotation can be switched between forward direction and reverse direction. In the drawing, the direction indicated by the arrow k is referred to as the forward direction. The roller 12 is a subordinate roller which is made movable in the direction of an arrow j by an unillustrated solenoid. In the beginning, the roller 12 is in the position of p shown in FIG. 7 and the roller 11 rotates in the forward direction. A tiles X conveyed is inserted between these rollers 11, 12 by the rotation of the roller 11 in the forward direction, and travels between these rollers until the tip of the tile X touches a micro switch 13 provided below the rollers and turns on the switch. When the tile X has been judged to be face down by the front/back judgment unit 3, it does not have to be turned over, so that the roller 12 moves to the position of q while the roller 11 continues to rotate in the forward direction. As a result of these operations, the tile X is discharged still face down onto a slope 14 shown in the bottom of the drawing. On the other hand, when the tile X has been judged to be face up by the front/back judgment unit 3, it has to be turned over, so that the roller 12 moves to the position of r and the rotation of the roller 11 shifts to the reverse direction. According to these operations, the tile X is released from between the rollers 11, 12 in an obliquely upward direction with its bottom in the direction of the travel of the tiles X and discharged with the face down onto a slope 15 above the slope 14.

Figure 8:
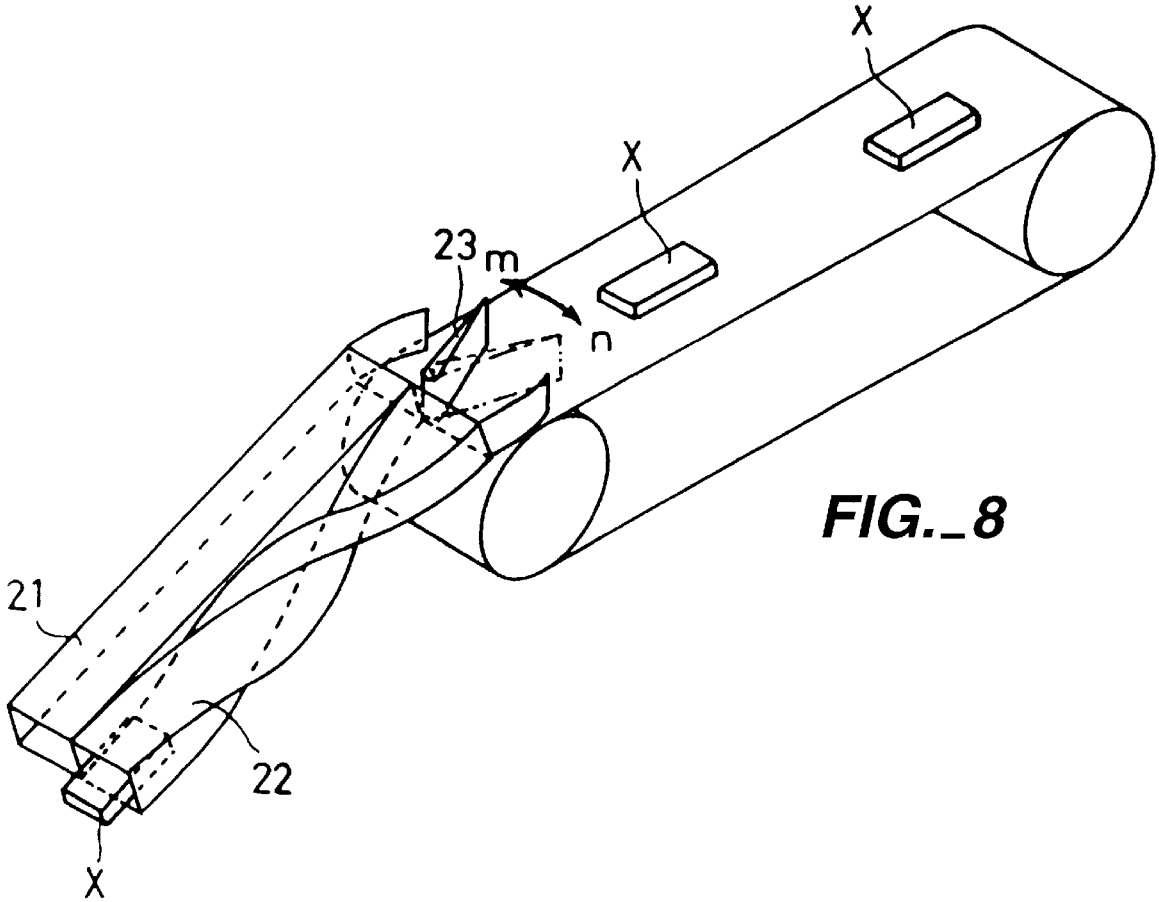
FIG. 8 is a perspective view of another modified example of the reversal unit.

FIG. 8 shows another reverse mechanism available. This reverse mechanism is composed of a passage 21 which consists of a straight rectangular parallelepiped with an inclination, a reversal passage 22 which consists of a half-twisted rectangular parallelepiped with an inclination, and a guide plate 23 which guides tiles X to either the passage 21 or the reversal passage 22 by being shifted between the directions of arrows m and n by an unillustrated solenoid. According to this structure, when a tile X has been conveyed with the front down, the guide plate 23 moves in the direction of n so as to guide the tile X to the passage 21. Consequently, the tile X passes through the passage 21 with the front down. In contrast, when the tile X has been conveyed with the front up, the guide plate 23 moves in the direction of m so as to guide the tile X to the reversal passage 22. Consequently, the tile X is turned over while passing through the reversal passage 22 and released therefrom with the front down.

Figure 9:
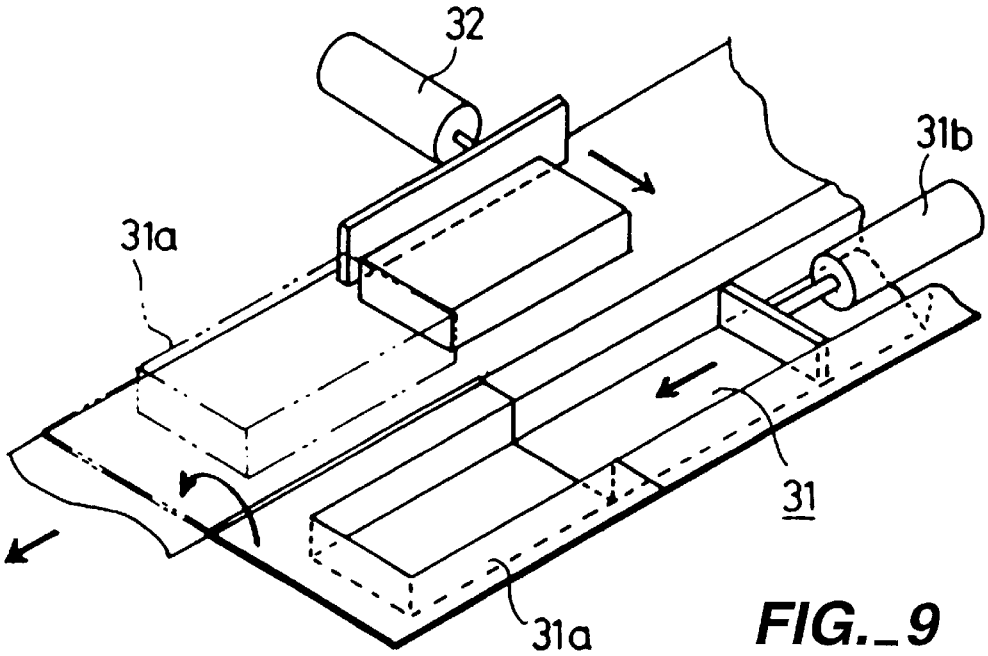
FIG. 9 is a perspective view of further another modified example of the reversal unit.

FIG. 9 shows a further another reverse mechanism available. This reverse mechanism is composed of a groove 31 which is parallel to the passage for the tiles X and whose depth is equal to the thickness of the tiles X, and a first pushing device 32 which is made to push the tiles X into the groove 31 by a solenoid. The groove 31 consists of an upset unit 31*a* which upsets itself with a tile X therein onto the passage by turning over on the side of the passage and a second pushing device 31*b* which is made to push the tile X towards the upset unit 31*a* by a solenoid. In this structure, when a tile X is conveyed with the front up, the first pushing device 32 pushes the tile X into the groove 31, and then the second pushing device 31*b* pushes the tile X towards the upset unit 31*a*. When the tile X is in, the upset unit 31*a* upsets itself with the tile X therein onto the passage. As a result of the overturn of the upset unit 31*a*, the tile X is turned face down. On the other hand, when a tile X has been conveyed with the front down, the tile X is conveyed intact through the passage. It is preferable to equalize the time required for pushing a tile X with the front up by the first pushing device 32 and overturning it onto the passage with the face down with the time required for passing a tiles X with the front down in front of the first pushing device and carrying it to the position where the upset unit 31*a* upsets itself. It is also possible to provide a supporting member which supports a tiles X from below like the upset unit 31*a* and rotates around a straight line as a rotation axis which goes through the top surface of the supporting member and is not in contact with the tiles X.

In addition to the above-described various reversal mechanisms, there are more measures including to pick up a tile X from a passage and place it in the passage again after turning it over.

Figure 10:
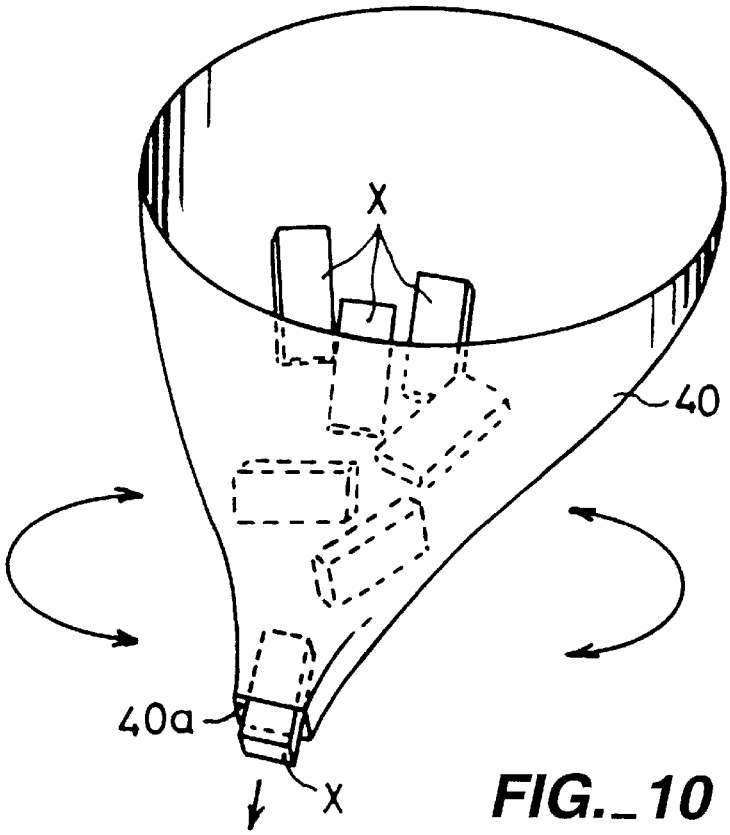
FIG. 10 is a perspective view of a modified example of the direction match unit.

As for the direction match unit, it is not limited to the one described in the present embodiment as long as it discharges tiles one by one with their flat side down and their longitudinal side in a predetermined direction. For example, such a hopper 40 can be adopted as having a square exit 40*a* of the right size for tiles to go through as shown in FIG. 10 and vibrating or rotating so as to release the tiles from the exit one by one with the fixed side down. Furthermore, a direction match unit utilizing the conveyer shown in the next embodiment can be adopted.

Although two sets of tiles are used in the present embodiment, one set or more than two sets can be used. This holds true in the next embodiment. When three sets are used, a shuffle mechanism is additionally provided before the direction match unit, and one set is used for the game which is being played, another set is placed in the arrangement process, and the other set is shuffled by the shuffle mechanism. Then, when tiles are put into the opening, the tiles which are shuffled until then are discharged from the shuffle mechanism to the direction match unit, and at the same time, a new set of tiles are put into the shuffle mechanism.

In the present embodiment, the judgment of the front and the back of the tiles X is conducted over the conveyer unit 2; however, it can be conducted before or in the vicinity of the outlet of the direction match unit 1.

Embodiment 2

The second embodiment of the present invention will be described with reference to the drawings as follows. Similar to the tiles arrangement device A of the first embodiment, the tiles arrangement device B of the present embodiment is used in the game table for paigow shown in FIG. 3 and operates to arrange tiles as shown in FIG. 2 when the tiles are put into the opening 104. Although the top surface of the lift serves as part of the table in the first embodiment, an open/close lid is provided in place of the top surface of the lift in the present embodiment.

Figure 11:
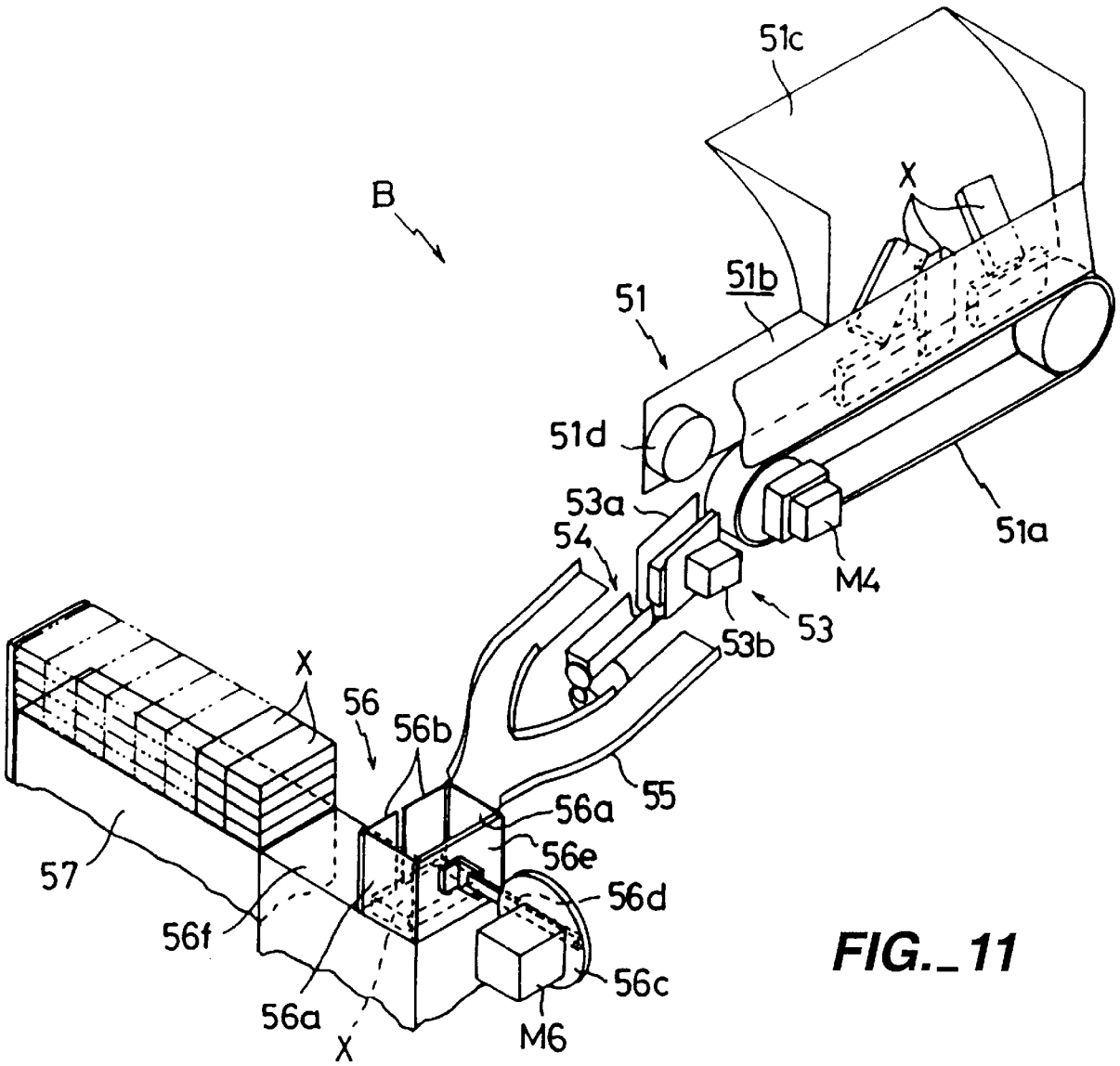
FIG. 11 is a perspective view of the structure of the tile arrangement device of the second embodiment.
Figure 12:
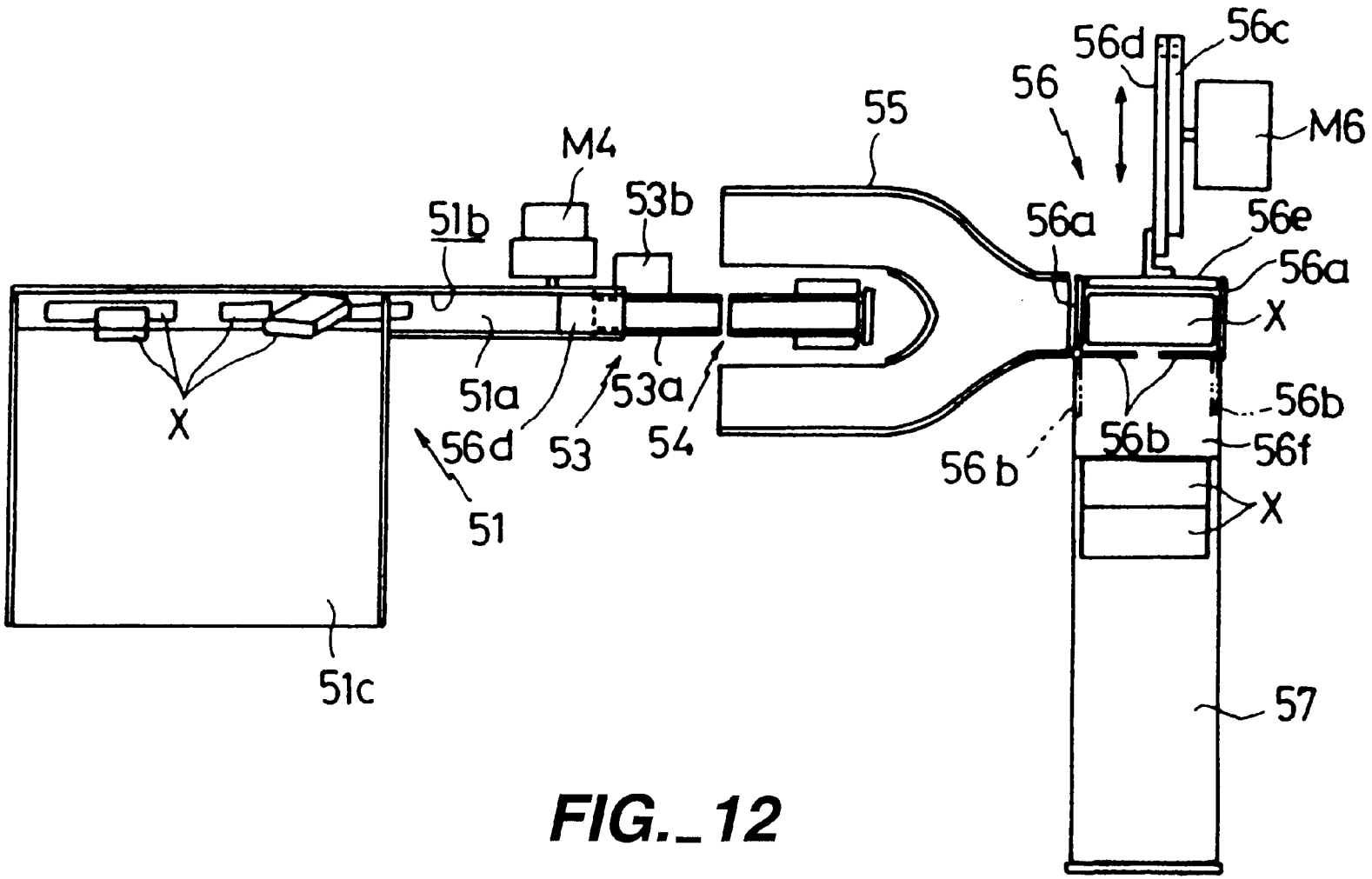
FIG. 12 is a plane view of the structure of the tile arrangement device of the second embodiment.

FIGS. 11 and 12 are respectively a perspective view and a plane view showing the structure of the tiles arrangement device B. The tiles arrangement device B is composed of a direction match unit 51 disposed under the opening 104 of the game table shown in FIG. 3, a front/back judgment unit 53 for passing through the tiles X discharged from the direction match unit 51 and judging the front and the back of the tiles X, an upset unit 54 for upsetting the tiles X in the direction according to the direction of the front and the back, a slope 55 for sliding tiles X which have been upset by the upset unit 54, a lift 57 for arranging tiles X as shown in FIG. 2 and then lifting them onto the top 101 of the game table, and a piling unit 56 for piling the tiles X passed through the slope 55 in the fixed number of levels and for forwarding them to the lift 57. Similar to the first embodiment, these units are controlled by a control device composed of CPU, RAM, ROM, and a driver to control driving sources such as motors all of which are unillustrated. The control is performed by a program to achieve the following operations which is stored in the ROM.

The direction match unit 51 is composed of a conveyer belt 51*a* for conveying tiles, a discharge roller 51*d* for discharging tiles X from the conveyer belt 51*a* to the front/back judgment unit 53, a guide groove 51*b* for guiding tiles X on the conveyer belt 51a, and a slope board 51*c* for sliding tiles X to guide them from the opening 104 of the game table to the guide groove 51*b*.

The conveyer belt 51*a* is stretched between two rollers to convey tiles towards the front/back judgment unit 53 by making a motor M4 drive one of the rollers. The guide groove 51*b* has a width slightly larger than the thickness of tiles X so as to keep them with their flat side in the vertical direction on the conveyer belt 51*a*. The side wall on the side opposite to the slope board 51*c* of the guide groove 51*b* is slightly slanted towards the slope board 51*c* in order to prevent tiles X slipped down the slope board 51*c* from stopping on the way. The discharge roller 51*d* holds a tiles X in corporation with the conveyer belt 51*a* so as to guide one to the front/back judgment unit 53. In addition, when tiles X are conveyed with their smallest side down, the discharge roller 51*d* turns them around to uniform the direction of the tiles X. The top end of the slope board 51*c* is almost as high as the top of the game table, so that tiles X are smoothly guided from the top into the guide groove 51*b*. Since the tiles X on the top are all laid with their flat side down, the tiles X slipped down the slope board 51*c* are smoothly guided into the guide groove 51*b*. When some tiles happen to be heaped in the guide groove 51*b*, the discharge roller 51*d* blocks the movement of the upper tiles so that the bottom tiles only is discharged first and the other tiles are dropped on the convey belt to be discharged towards the front/back judgment unit 53.

The front/back judgment unit 53 is composed of a slanting groove 53*a* and a judgment sensor 53*b*. The slanting groove 53*a* receives the tiles X discharged from the direction match unit 51 and guide them to the upset unit 54. The judgment sensor 53*b*, which is composed of an optical sensor as in the first embodiment, judges which side of the tiles X is the front based on the color density of the side. Similar to the first embodiment, the front/back judgment unit can be formed into various types. For example, it is possible to detect bar codes optically, to detect magnetic paint applied on one of the front and the back with a magnetic sensor, or to detect the presence or absence of a convexity and a concavity provided at the fixed portion of the front and the back through physical contact.

Figure 13:
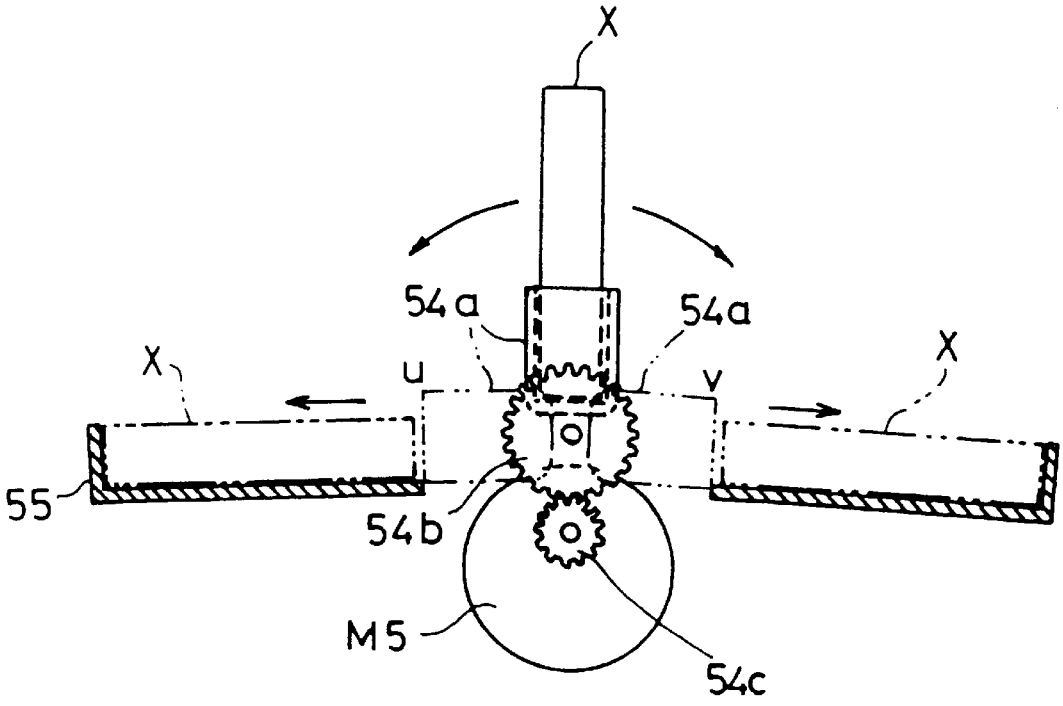
FIG. 13 is a plane view of the upset unit.

The upset unit 54 receives tiles X from the front/back judgment unit 53, upsets them on the side judged to be the front, thereby to divide them into the two passages of a slope 55 which will be described below. FIG. 13 is a view of the upset unit 54 seen from the side opposite to the direction of the travel of the tiles X. The upset unit 54 is composed of a bucket 54*a* for supporting the received tiles X one for each time and turning around a rotation axis which is provided on the bottom surface of the bucket 54*a* in parallel to the direction of the travel of the tiles X, a first gear 54*b* attached to the rotation axis, and a second gear 54*c* engaged with the first gear 54*b* and driven by a motor M5. The rotation of the motor M5 can be switched between the forward direction and the reverse direction, which allows the bucket 54*a* to turn to the position of u or v shown in the drawing. At the position of u or v, the opening of the bucket 54*a* is turned in an obliquely downward direction, which makes the tiles X in the bucket 54*a* slip down onto the slope 55. At this moment, the tiles X are turned on the side of the front, so that all the tiles X travel to the slope 55 with the front down.

As shown in FIG. 13, the slope 55 has two slanting passages on both sides of the upset unit 54. The two passages are joined down the slope 55 so that the tiles X divided into the two passages by the upset unit 54 are both guided to the piling unit 56 with the front down.

The piling unit 56 is composed of two fixed side walls 56*a*, 56*a* opposed to each other, an open/close door 56*b* attached to the vertical edge of the side walls 56*a*, 56*a* on the lift 57 side, a pushing board 56*e* which slides between the side walls 56*a*, 56*a*, crank arms 56*c*, 56*d* which compose a crank mechanism for sliding the pushing board 56*e*, and a slide stand 56*f* which fixes the side walls 56*a*, 56*a* and on which the pushing board 56*e* slides.

When the crank mechanism is entirely withdrawn and the pushing board 56*e* is in the farthest position from the lift 57, the space enclosed by the pushing board 56*e*, the side walls 56*a*, 56*a*, and the door 56*b* is designed to have a bottom area of nearly the same shape as a flat side of a tiles X and nearly the same height as tiles X in four levels. In other words, the space has a similar shape to tiles X piled in four levels. An edge of the slide stand 56*f* is in contact with an edge of the lift 57, and when the crank mechanism is fully stretched, the pushing surface of the pushing board 56*e* is supposed to reach the edge of the lift 57. The door 56*b*, which is usually closed by a spring as shown in FIG. 11, opens when pushed from the side of the pushing board 56*e*. The above-mentioned space is provided with an unillustrated weight sensor for detecting the weight of the tiles X put into the space. According to this structure, the tiles X conveyed through the slope 55 are piled in the above-mentioned space and when the weight sensor detects the weight for four tiles, the crank mechanism is stretched to make the pushing board 56*e* push the piled tiles onto the lift 57.

The lift 57, which is moved vertically by an elevation mechanism such as a ball thread, lifts the arranged tiles X onto the top of the game table shown in FIG. 3. In the first embodiment, the lift 8 is in the highest position so as to form a part of the top 101 while the game is being played; however, in the present embodiment the lift 57 is in the lowest position during the game and rises only to lift the arranged tiles onto the top 101. The top 101 has a lid which opens automatically.

The operations of the tile arrangement device B having the above-mentioned structure will be described as follows. When one game is over, the dealer operates the switch box 103 on the game table shown in FIG. 3. Consequently, the opening 104 is opened by an unillustrated open/close mechanism and the slope board 51*c* of the direction match unit 51 is exposed so as to slide tiles X down the slope board 51*c*. As soon as the opening 104 is opened, the tile arrangement device B starts to operate and the conveyer belt 51*a* of the direction match unit 51 starts to rotate. In the present embodiment, too, two sets of tiles are used: while one set of tiles are used for the game, the other set of tiles are arranged on the lift 57 during the game, ready to be lifted a fixed time period after the opening 104 is closed.

The tiles X which have been slipped down the slope 51 of the direction match unit 51 are put into the guide groove 51*b*, conveyed on the conveyer belt 51, and discharged one by one from between the discharge roller 51*d* and the conveyer belt 51*a* to the front/back judgment unit 53 with their longer edge down.

The tiles X sent to the front/back judgment unit 53 are judged which side is the front. Since the judgment sensor 53*b* is on the left side in the direction of the travel of the tiles X, when it detects a high density, the right side in the direction of the travel of the tiles X is judged to be the front whereas when it detects a low density, the left side in the direction of the travel of the tiles X is judged to be the front.

After the judgment of the front/back judgment unit 53, the tiles X are guided into the bucket 54*a* of the upset unit 54. When a tile X enters the bucket 54*a*, the motor M5 rotates in the direction in accordance with the judgment results of the front/back judgment unit 53, so as to turn the bucket 54*a* with the tile X therein via the second gear 54*c* and the first gear 54*b*. To be more specific, when the front/back judgment unit 53 has judged that the right side in the direction of the travel of the tiles X to be the front, the bucket 54*a* is tilted to the right side whereas when the left side in the direction of the travel of the tiles X has been judged to be the front, the bucket 54*a* is tilted to the left side. The tiles X are sent to the slope 55 with the front down as a result of the turning of the bucket 54*a*. Then, the tiles X slip down the slope 55 as they are and are discharged to the piling unit 56.

In the piling unit 56, the crank arm 56*d* of the crank mechanism is usually entirely withdrawn so as to form the above-mentioned space which is nearly the same shape as tiles X piled in four levels. The tiles X sent through the slope 55 are entered in the space and piled therein. When four tiles X are piled, an unillustrated weight sensor detects this, and the crank mechanism operates to stretch the crank arm 56*d*, thereby to push the tiles X piled in four levels onto the lift 5 via the pushing board 56*e*. Every time the bucket 54*a* has turned four times, its movement is suspended until the crank mechanism of the piling unit 56 stretches and then returns to the original state. As a result, tiles X are prevented from slipping down before the above-mentioned space is formed.

In this manner, every time four tiles have been piled, they are pushed onto the lift 57, and when this operation is repeated eight times, the tiles X are arranged as shown in FIG. 2 on the lift 57. Since the operations so far require far less time than to finish one game, the lift 57 waits in this condition for the next game. A predetermined time period after the dealer operates the switch box 103 when the game is over, the lift 57 rises in order to lift the arranged tiles X onto the top 101. In this way, the tiles X are automatically arranged, carried to the top 101, and used for the next game.

Figure 14:
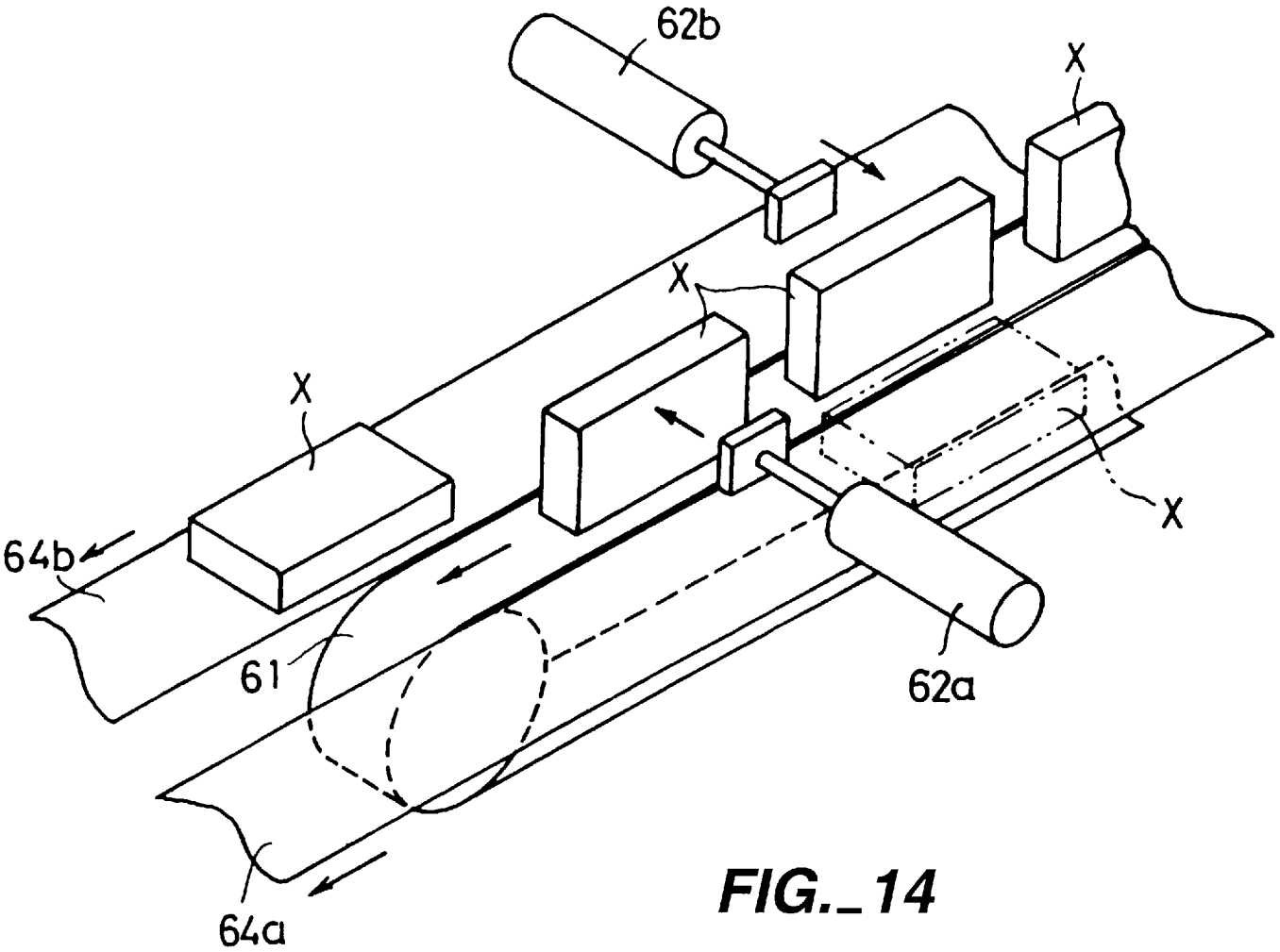
FIG. 14 is a perspective view of a modified example of the upset unit.

In the present embodiment, tiles X are overturned by tilting the bucket 54*a* of the upset unit 54; however, this method can be replaced by such a mechanism as overturns tiles X by pushing the upper portion of the tiles X standing with their flat side in the vertical direction as shown in FIG. 14. In this mechanism, the first conveyer belt 61 conveys tiles X standing with their flat side in the vertical direction, and the air cylinders 62*a*, 62*b* each provided to face the flat side pushes the upper portion of the back of the tiles X to turn them to the side of the front. The tiles X thus overturned are conveyed face down either on a second conveyer belt 64*a* or on a third conveyer belt 64*b* which are provided at both sides of the first conveyer belt 61 in parallel therewith. As described hereinbefore, overturning tiles X can be realized by various mechanisms.

Furthermore, the direction match unit 51 of the present embodiment can be structured by various mechanisms as in the first embodiment, and optional mechanisms such as the piling unit can be exchanged between the first embodiment and the second embodiment.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. A tile arrangement device comprising:

a direction match unit for discharging tiles put in disorder one by one, said tiles being flat and rectangular parallelepipeds each having two flat sides corresponding to a front and a back of said tiles and edge sides being adjacent to said two flat sides; said direction match unit discharging said tiles with one of the edge sides down in a manner that a longitudinal direction of said tiles matches a predetermined direction;

a front/back judgment unit for judging whether the front and the back of said tiles discharged from said direction match unit respectively face the right and the left in a direction of travel of said tiles or not;

an upset unit for upsetting said tiles discharged from said direction match unit to one of the right and the left in the direction of the travel of said tiles in order to turn said tiles with a desired side of the front and the back down; and an arrangement unit for arranging said tiles passed through said upset unit in predetermined conditions.

2. The tile arrangement device of claim 1, wherein when the front and the back of said tiles differ in color density, said front/back judgment unit comprises an optical sensor for detecting a color density of at least one of the front and the back of said tiles.

3. The tile arrangement device of claim 1, wherein when at least one of the front and the back of said tiles is magnetic and the front and the back differ in magnetism, said front/back judgment unit comprises a magnetic sensor for detecting magnetism of at least one of the front and the back of said tiles.

4. The tile arrangement device of claim 1, wherein when at least one of the front and the back of said tiles has a specific symbol, said front/back judgment unit optically detects a presence or absence of the specific symbol from at least one of the front and the back of said tiles.

5. The tile arrangement device of claim 1, wherein when at least one of the front and the back of said tiles has a specific shape formed at a fixed position thereof, said front/back judgment unit detects a presence or absence of the specific shape by making physical contact with at least one of the front and the back of said tiles.

6. The tile arrangement device of claim 1, wherein said upset unit upsets said tiles by tilting said supporting member to one of the right and the left in the direction of the travel of said tiles, to which said tiles are supposed to be upset.

7. The tile arrangement device of claim 1, wherein said upset unit upsets said tiles by pushing an upper portion of one of said two flat sides, said one of said two flat sides being opposite to one of the right and the left in the direction of the travel of said tiles, to which said tiles are supposed to be upset.

8. The tile arrangement device of claim 1, wherein when said predetermined conditions are a fixed number of rows of a fixed number of levels each, said arrangement unit comprises:

an arrangement stand for supporting a bottom surface of said tiles;

a slide mechanism for sliding said tiles one by one onto said arrangement stand;

an elevation mechanism for lowering said arrangement stand against said slide mechanism in levels each corresponding to a thickness of said tiles; and a control unit for operating said elevation mechanism when said tiles are arranged in said fixed number of rows on said arrangement stand.

9. The tile arrangement device of claim 1, wherein when said predetermined conditions are a fixed number of rows of a fixed number of levels each, said arrangement unit comprises:

an arrangement stand for supporting a bottom surface of said tiles;

a piling unit for piling said tiles in said fixed number of levels; and a slide mechanism for sliding piled tiles intact onto said arrangement stand.

10. A tile arrangement device comprising:

a direction match unit for discharging tiles put in disorder one by one, said tiles being flat and rectangular parallelepipeds each having two flat sides corresponding to a front and a back of said tiles wherein at least one of the front and the back of said tiles has a specific shaped formed at a fixed position thereof, said direction match unit discharging said tiles with a flat side down in a manner that a longitudinal direction of said tiles matches a predetermined direction;

a front/back judgment unit for judging whether each of said tiles discharged from said direction match unit is turned the front down or the back down by detecting a presence or absence of the specific shape by making physical contact with at least one of the front and the back of said tiles;

a reversal unit for, when said front/back judgment unit has judged that the front and the back of said tiles discharged from said direction match unit are not in desired directions, passing said tiles while reversing, and when said front/back judgment unit has judged that the front and the back of said tiles are in desired directions, passing said tiles without reversing; and an arrangement unit for arranging said tiles passed through said reversal unit in a fixed number of rows of a fixed number of levels each.

11. A tile arrangement device comprising:

a direction match unit for discharging tiles put in disorder one by one, said tiles being flat and rectangular parallelpipeds each having two flat sides corresponding to a front and a back of said tiles, said direction match unit discharging said tiles with a flat side down in a manner that a longitudinal direction of said tiles matches a predetermined direction;

a front/back judgment unit for judging whether each of said tiles discharged from said direction match unit is turned the front down or the back down;

a reversal unit for, when said front/back judgment unit has judged that the front and the back of said tiles discharged from said direction match unit are not in desired directions, passing said tiles while reversing said tiles by holding said two flat sides of said tiles between rollers provided downstream in a direction of travel of said tiles, and discharging said tiles backward with a bottom of said tiles in the direction of the travel of said tiles, and when said front/back judgment unit has judged that the front and the back of said tiles are in desired directions, passing said tiles without reversing; and an arrangement unit for arranging said tiles passed through said reversal unit in a fixed number of rows of a fixed number of levels each.

12. A tile arrangement device comprising:

a direction match unit for discharging tiles put in disorder one by one, said tiles being flat and rectangular parallelpipeds each having two flat sides corresponding to a front and a back of said tiles, said direction match unit discharging said tiles with a flat side down in a manner that a longitudinal direction of said tiles matches a predetermined direction;

a front/back judgment unit for judging whether each of said tiles discharged from said direction match unit is turned the front down or the back down;

a reversal unit for, when said front/back judgment unit has judged that the front and the back of said tiles discharged from said direction match unit are not in desired directions, passing said tiles while reversing said tiles by supporting said tiles with a supporting member from below said tiles and rotating said supporting member around a straight line as rotation axis while said tiles are supported, said straight line going through a top surface of said supporting member and being not in contact with the tile supported, and when said front/back judgment unit has judged that the front and the back of said tiles are in desired directions, passing said tiles without reversing; and an arrangement unit for arranging said tiles passed through said reversal unit in a fixed number of rows of a fixed number of levels each.

13. A tile arrangement device comprising:

a direction match unit for discharging tiles put in disorder one by one, said tiles being flat and rectangular parallelpipeds each having two flat sides corresponding to a front and a back of said tiles, said direction match unit discharging said tiles with a flat side down in a manner that a longitudinal direction of said tiles matches a predetermined direction;

a front/back judgment unit for judging whether each of said tiles discharged from said direction match unit is turned the front down or the back down;

a reversal unit having a first passage for passing said tiles while reversing them, a second passage for passing said tiles without reversing them, and a guide mechanism for dividing said tiles into the first passage and the second passage for, when said front/back judgment unit has judged that the front and the back of said tiles discharged from said direction match unit are not in desired directions, passing said tiles while reversing, and when said front/back judgment unit has judged that the front and the back of said tiles are in desired directions, passing said tiles without reversing; and an arrangement unit for arranging said tiles passed through said reversal unit in a fixed number of rows of a fixed number of levels each.

14. A tile arrangement device comprising:

a direction match unit for discharging tiles put in disorder one by one, said tiles being flat and rectangular parallelpipeds each having two flat sides corresponding to a front and a back of said tiles, said direction match unit discharging said tiles with a flat side down in a manner that a longitudinal direction of said tiles matches a predetermined direction;

a front/back judgment unit for judging whether each of said tiles discharged from said direction match unit is turned the front down or the back down;

a reversal unit for, when said front/back judgment unit has judged that the front and the back of said tiles discharged from said direction match unit are not in desired directions, passing said tiles while reversing, and when said front/back judgment unit has judged that the front and the back of said tiles are in desired directions, passing said tiles without reversing; and an arrangement unit for arranging said tiles passed through said reversal unit in a fixed number of rows of a fixed number of levels each, said arrangement unit having:

an arrangement stand for supporting a bottom surface of said tiles;

a slide mechanism for sliding said tiles one by one onto said arrangement stand;

an elevation mechanism for lowering said arrangement stand against said slide mechanism in levels each corresponding to a thickness of said tiles; and a control unit for operating said elevation mechanism when said tiles are arranges in said fixed number of rows on said arrangement stand.

15. A tile arrangement device comprising:

a direction match unit for discharging tiles put in disorder one by one, said tiles being flat and rectangular parallelpipeds each having two flat sides corresponding to a front and a back of said tiles, said direction match unit discharging said tiles with a flat side down in a manner that a longitudinal direction of said tiles matches a predetermined direction;

a front/back judgment unit for judging whether each of said tiles discharged from said direction match unit is turned the front down or the back down;

a reversal unit for, when said front/back judgment unit has judged that the front and the back of said tiles discharged from said direction match unit are not in desired directions, passing said tiles while reversing, and when said front/back judgment unit has judged that the front and the back of said tiles are in desired directions, passing said tiles without reversing; and an arrangement unit for arranging said tiles passed through said reversal unit in a fixed number of rows of a fixed number of levels each, said arrangement unit having:

an arrangement stand for supporting a bottom surface of said tiles;

a piling unit for piling said tiles in said fixed number of levels; and a slide mechanism for sliding piled tiles intact onto said arrangement stand.

* * * * *